US005419690A

United States Patent [19]

Goto et al.

[11] Patent Number: 5,419,690

[45] Date of Patent: May 30, 1995

[54] SCROLL TYPE REFRIGERANT COMPRESSOR WITH MEANS FOR PREVENTING MECHANICAL CRACK OF THE HOUSING

[75] Inventors: Kunifumi Goto; Tetsuhiko Fukanuma; Tetsuo Yoshida; Shinya Yamamoto, all of Kariya, Japan

[73] Assignee: Kabushiki Kaisha Toyoda Jidoshokki Seisakusho, Aichi, Japan

[21] Appl. No.: 191,455

[22] Filed: Feb. 3, 1994

[30] Foreign Application Priority Data

Feb. 9, 1993 [JP] Japan ..... 5-021473

[51] Int. Cl.[6] ..... F04C 18/04

[52] U.S. Cl. ..... 418/55.1; 418/55.2; 418/178; 418/179

[58] Field of Search ..... 418/55.2, 178, 179, 418/55.1

[56] References Cited

U.S. PATENT DOCUMENTS

| | | | |
|---|---|---|---|
| 3,202,103 | 8/1965 | Sully | 418/178 |
| 3,989,421 | 11/1976 | Ritchie | 418/178 |
| 4,464,101 | 8/1984 | Shibuya | 418/178 |
| 4,645,436 | 2/1987 | Sakamoto | 418/55.2 |

FOREIGN PATENT DOCUMENTS

| | | | |
|---|---|---|---|
| 61-38189 | 2/1986 | Japan . | |
| 2-86978 | 3/1990 | Japan | 418/55.2 |
| 2-283891 | 11/1990 | Japan | 418/178 |
| 3-134287 | 6/1991 | Japan . | |
| 4-66792 | 3/1992 | Japan | 418/55.2 |

*Primary Examiner*—John J. Vrablik

*Attorney, Agent, or Firm*—Burgess, Ryan & Wayne

[57] ABSTRACT

A scroll type refrigerant compressor having an aluminum or aluminum alloy housing unit in which a stationary scroll unit having a stationary spiral member and a movable scroll unit having a movable spiral member are encased in such a manner that the movable spiral member moves along a predetermined orbiting path without rotating about an axis thereof, and a reinforcing ferric metal liner fixedly attached to an inner cylindrical face of a cylindrical wall portion of the aluminum or aluminum alloy housing unit so as to prevent the inner cylindrical face of the housing unit from being mechanically cracked by the movable spiral member of the movable scroll unit during the running of the compressor even if the movable scroll unit jams due to entrance of foreign materials between the outer face of the movable spiral member and the inner face of the housing unit.

12 Claims, 3 Drawing Sheets

SCROLL TYPE REFRIGERANT COMPRESSOR WITH MEANS FOR PREVENTING MECHANICAL CRACK OF THE HOUSING

BACKGROUND OF THE INVENTION

1. Field of the Invention

The present invention generally relates to a scroll type refrigerant compressor provided with a stationary scroll unit stationarily arranged in a housing and a movable scroll unit cooperating with the stationary scroll unit so as to compress refrigerant gas, and more particularly, relates to a scroll type refrigerant compressor with means for preventing mechanical breakage of the housing.

2. Description of the Related Art

U.S. Pat. No. 4,824,346 discloses a typical scroll type refrigerant compressor. The scroll type refrigerant compressor is provided with a stationary scroll unit fixedly encased in a housing means, and a movable scroll unit orbiting in the housing means so as to compress refrigerant gas in cooperation with the stationary scroll unit. The stationary scroll unit includes a stationary spiral member and an end plate member fixedly attached to an end of the spiral member and to the housing means. The stationary spiral member is formed as a wall member extending spirally along an involute curve with respect to a given point, i.e., a center of the stationary spiral member.

The movable scroll unit includes a movable spiral member engaged with the stationary spiral member and a movable end plate fixed to an end of the movable spiral member on the side axially opposite to the end plate member of the stationary scroll unit. The movable spiral member which is also formed as a wall member extending spirally along an involute curve with respect to a given point, i.e., a center of the movable spiral member is arranged so as to be circumferentially shifted the stationary scroll member by a given angle. Thus, when the movable scroll unit orbits along a predetermined circular path with respect to the stationary scroll unit, the refrigerant gas is pumped from a suction chamber arranged in a radially outer portion of the stationary and movable spiral members into a closed compressing chamber formed between the stationary and movable scroll members. The compressing chamber is shifted from the outer portion of the stationary and movable spiral members toward the center thereof in relation to the orbiting motion of the movable spiral member, and during the shifting of the compressing chamber, the volume thereof is gradually reduced so as to compress the refrigerant gas. When the compressing chamber reaches the center of the two spiral members, the compressed refrigerant gas is discharged from the compressing chamber toward a discharge chamber through a discharge port centrally formed in the end plate member of the stationary scroll unit.

Further, the stationary scroll unit including the stationary spiral member is made of aluminum alloy so as to reduce the weight thereof. In addition, the housing means in which the stationary scroll unit is encased is usually made of aluminum alloy to reduce the overall weight of the compressor.

The stationary scroll unit and the encasing housing means may either be separate members as shown in Japanese Unexamined Japanese Patent Publication (Kokai) No. 61-38189 or may be a single light and small-diameter integral member made of aluminum alloy as disclosed in Japanese Unexamined Patent publication (Kokai) No. 3-134287.

In the above-described conventional scroll type refrigerant compressor, the movable spiral member of the movable scroll unit moves along a predetermined circular path, that is, the movable scroll unit orbits along the predetermined path under such a condition that the turning of the movable spiral member about the center thereof is prevented. When the movable spiral member orbits maintaining an engagement between the stationary and movable spiral members, seizure of the stationary and movable spiral members there may occur due to strong contact of the two members during continuous running of the compressor, and accordingly, the two stationary and movable spiral members may be mechanically damaged. Thus, a piece or pieces of the broken members may enter between the outer wall of the movable spiral member and the inner wall of the housing means so as to jam the movable scroll unit to thereby eventually crack the housing means which is made of a breakable material such as aluminum alloy. The breakage of the housing means of the scroll type refrigerant compressor permits the leakage of Freon gas used as refrigerant gas into the atmosphere, and results in an undesirable problem from the viewpoint of environmental protection.

SUMMARY OF THE INVENTION

Therefore, an object of the present invention is to provide a scroll type refrigerant compressor provided with means for preventing mechanical crack of the compressor housing even under such a condition that jamming of the movable spiral member occurs due to entrance of foreign materials such as broken pieces of the stationary and movable spiral members between the spiral member of the movable scroll unit and the inner wall of the compressor housing during running of the compressor.

In accordance with the present invention, there is provided a scroll type refrigerant compressor which comprises:

- a housing unit made of light material such as aluminum or aluminum alloy, and having a substantially cylindrical wall defining an encasing space therein;
- a stationary scroll unit including a stationary spiral member attached to a first end plate and fixedly encased in the encasing space of the housing means;
- a movable scroll unit movably encased in the encasing space of the housing unit and cooperating with the stationary scroll unit, the movable scroll unit including a movable spiral member arranged so as to be angularly shifted with respect to the stationary spiral member and attached to a second end plate disposed at a position axially spaced apart and opposed to the first end plate of the stationary scroll unit, the movable spiral member of the movable scroll unit being arranged so as to be non-rotatable about a center thereof and moved along a predetermined orbiting path with respect to the stationary scroll unit under such a condition that, during the orbiting movement of the movable spiral member, partial engagement thereof with the stationary spiral member is constantly maintained so as to define a closed compressing chamber therebetween gradually reducing a volume thereof by shifting from an outer region toward a central region of the stationary and movable scroll units, and reinforcing metallic plate means for lining an inner cylindrical face of the cylindrical wall of the housing unit made of the aluminum or aluminum alloy, the reinforcing metallic plate means having mechanical strength sufficient for preventing the inner cylindrical face of the cylindrical wall of the housing unit from being mechanically damaged by the movable spiral member of the movable scroll unit.

Preferably, the reinforcing metallic plate means comprises a piece of ferric metal liner adhesively attached to the inner cylindrical face of the cylindrical wall of the housing unit.

The ferric metal liner mechanically far stronger than the aluminum system metallic material, and accordingly, the housing unit of the scroll type compressor is protected from crack even under such a condition as when foreign materials such as metallic small pieces accidentally enter between the movable spiral member of the movable scroll unit and the inner cylindrical face of the cylindrical wall of the housing unit so as to cause jamming of the movable spiral member of the movable scroll unit. Namely, when the jamming of the movable spiral member occurs, the movable spiral member will be initially broken so that cracking of the housing unit may be avoided. Thus, the problem of leakage of Freon gas from the interior of the compressor can be prevented.

BRIEF DESCRIPTION OF THE DRAWINGS

The above and other objects, features and advantages of the present invention will be made apparent from the ensuing description of preferred embodiments thereof with reference to the accompanying drawings wherein.

DESCRIPTION OF PREFERRED EMBODIMENTS

Figure 1:
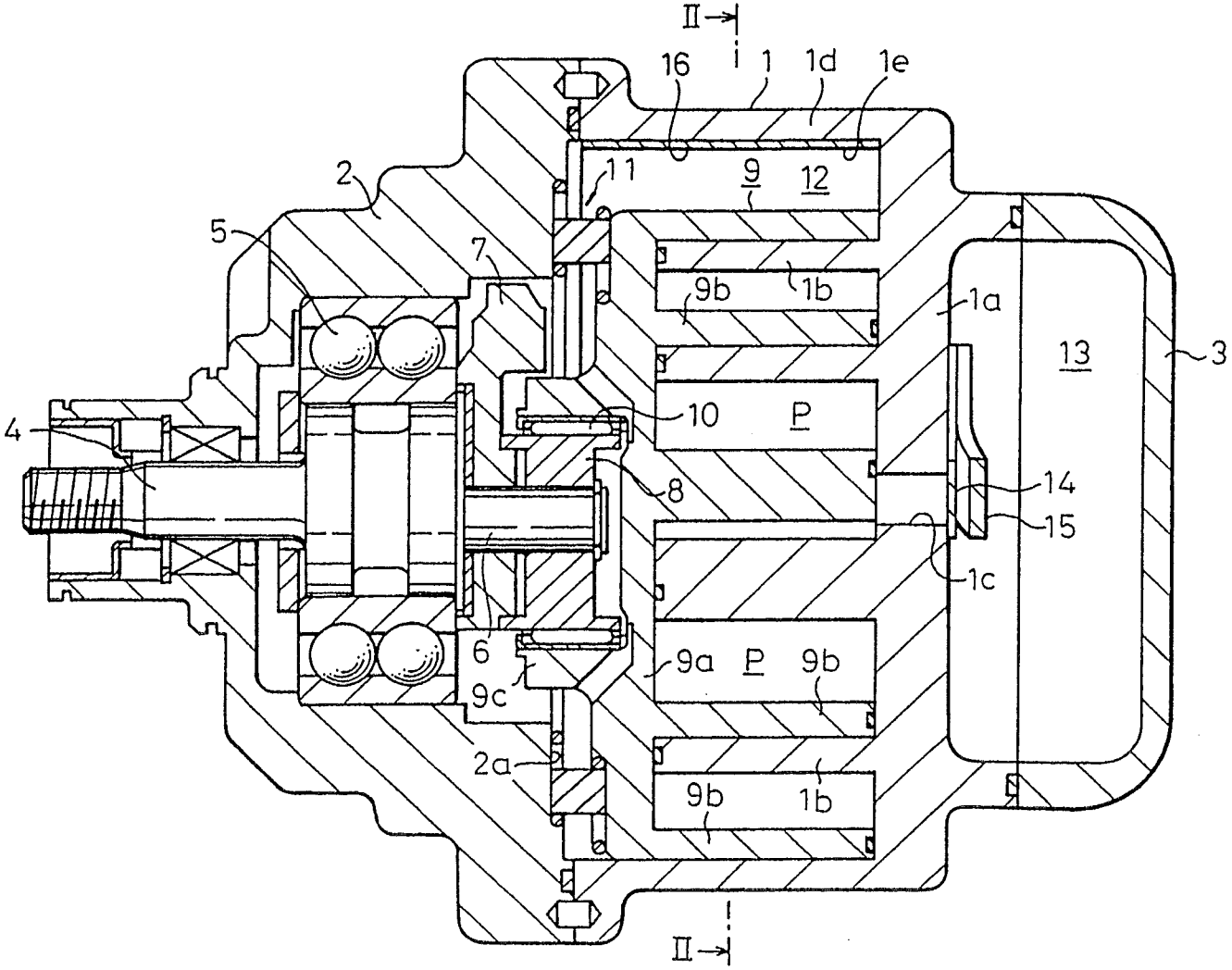
FIG. 1 is a longitudinal cross-sectional view of a scroll type refrigerant compressor according to an embodiment of the present invention.

Referring to FIG. 1, a scroll type refrigerant compressor according to an embodiment of the present invention includes a stationary scroll unit 1 and a movable scroll unit 9.

The stationary scroll unit 1 is provided with an end plate 1*a* in the form of a circular disc, a stationary spiral member 1*b* integrally attached to an inner face of the end plate, a discharge port 1*c* centrally formed in the end plate 1*a*, and a housing unit 1*d* in the form of a hollow cylindrical wall member having a cylindrical space therein.

The stationary spiral member 1*b* of the stationary scroll unit 1 extends along, for example, an involute curve with respect to a given central axis of the end plate 1*a*. The housing unit 1*d* of the stationary scroll unit 1 has a front end to which a front housing 2 is sealingly attached, and a rear end to which a rear housing 3 is sealingly attached.

The front housing 2 is provided with a rotary type bearing 5 mounted therein for rotatably supporting thereon a drive shaft 4 to which an eccentric shaft 6 is integrally attached. The eccentric shaft 6 may be formed integrally with the drive shaft 4, and supports thereon a balance weight 7 and a bushing member 8 which per se are provided with known constructions and functions.

The movable scroll unit 9 is provided with an end plate 9*a* at a position axially spaced apart from and opposed to the end plate 1*a* of the stationary scroll unit 1, and a movable spiral member 9*b* attached to the end plate 9*a* and extending along the same curve as that of the stationary spiral member 1*a* of the stationary scroll unit 1.

The end plate 9*a* of the movable scroll unit 9 is provided with an integrally-formed cylindrical boss 9*c* centrally arranged and extending frontward so as to be rotatably fitted on an outer circumference of the above-mentioned bushing member 8 via a radial bearing element 10.

Figure 2:
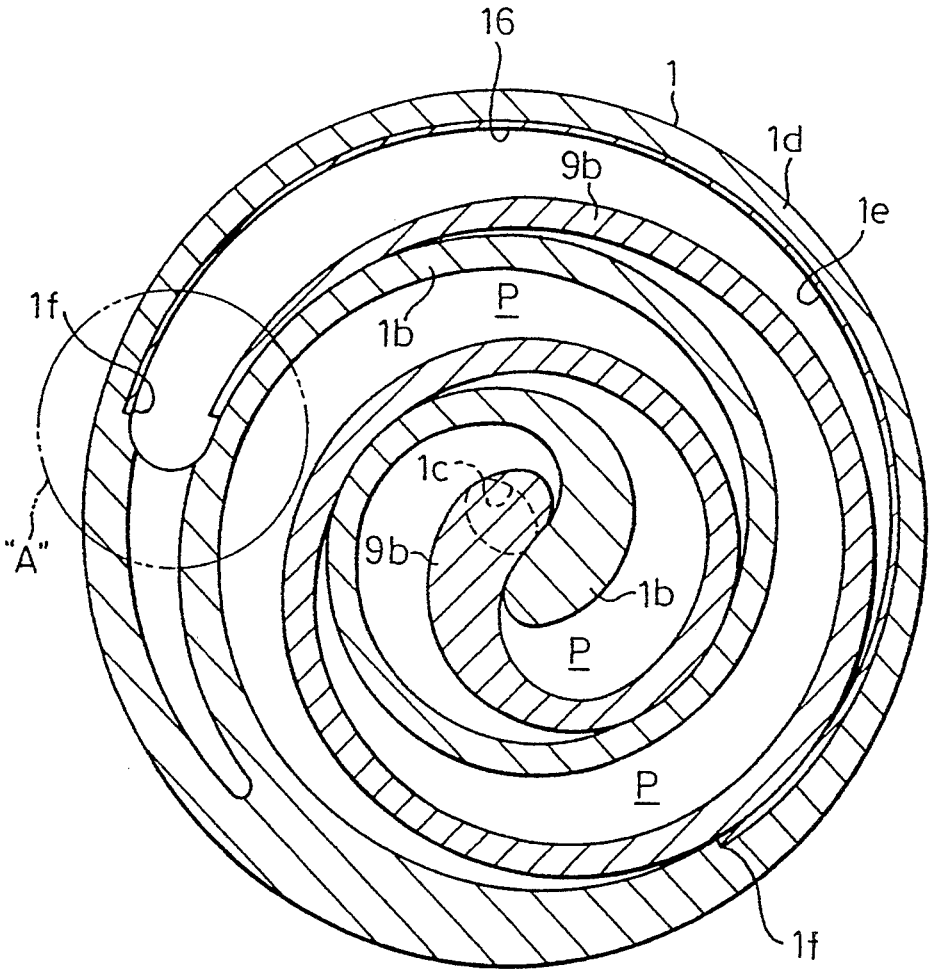
FIG. 2 is a cross-sectional view taken along the line II—II of FIG. 1.

Chambers designated by "P" in FIGS. 1 and 2 are compressing chambers defined by the axially opposed two end plates 1*a* and 9*a*, and the stationary and movable spiral members 1*b* and 9*b* of the stationary and movable scroll units 1 and 9.

As best shown in FIG. 1, a rotation preventing means 11 is arranged between a pressure-receiving inner face 2*a* of the front housing 2 facing the movable scroll unit 9 and a back face of the end plate 1*a* of the movable scroll unit 9. The rotation preventing means 11 prevents the movable scroll unit 9 from rotating about a center thereof and permits the scroll unit 9 to move along a predetermined orbiting path with respect to the stationary scroll unit 1. The orbiting motion of the movable spiral member 9*a* permits each of the compressing chambers P to be shifted from an outer region of the stationary and movable spiral members 1*b* and 9*b* toward the central region of the two members while gradually reducing the volume thereof. Thus, refrigerant gas introduced into the compression chambers P at the outer region is gradually compressed therein during shifting of the compression chambers P. During compression of the refrigerant gas, reaction forces acting on the movable scroll unit 9 are received by the aforementioned pressure-receiving inner face 2*a* of the front housing 2.

The scroll type compressor is provided with a suction chamber 12 arranged at a radially outer region of the stationary and movable spiral members 1*b* and 9*b*. The suction chamber 12 is fluidly connected to an external refrigerant suction conduit of an air-conditioning system via a suction flange member (not shown in FIG. 1). Thus, the refrigerant gas before compression is periodically pumped from the suction chamber into the above-mentioned compressing chambers P during the operation of the compressor. The compressed refrigerant gas is discharged from each of the compressing chambers P toward a discharge chamber 13 formed in the rear housing 3, via a discharge port 1*c* provided in the center of the end plate 1*a* of the stationary scroll unit 1. The discharge chamber 1*c* of the rear housing 3 is fluidly communicated with an exterior discharge refrigerant conduit of the air-conditioning system via a discharge flange element (not shown in FIG. 1). The discharge port 1c of the end plate 1a is closed by a discharge valve 14 backed up by a valve retainer element 15.

When the afore-mentioned eccentric shaft 6 is rotated by the drive shaft 4 along a circular path defined around the axis of rotation of the drive shaft 4, the movable scroll unit 9 is moved along the aforementioned predetermined orbiting path, and therefore, the abovementioned compression of the refrigerant gas and the discharge of the compressed refrigerant gas are successively performed.

Referring now to FIG. 2, in addition to FIG. 1, the housing unit 1d of the stationary scroll unit 1 in the form of a cylindrical wall has a cylindrical inner face provided with a circumferentially extending recess 1e having a small depth (e.g., 1.0 mm). The recess 1e is formed so as to entirely extend over at least a region of the wall portion of the housing unit 1d which portion has a thickness substantially identical to that of the movable spiral member 9b of the movable scroll unit 9.

The recess 1e of the cylindrical inner face of the housing unit 1d is limited, at the opposite ends thereof, by shoulders 1f in the form of a step.

A reinforcing ferric metal liner 16 in the form of a thin (e.g., 1.0 mm) cylindrically extending plate is applied to the recess 1e of the housing unit 1. The extreme ends of the cylindrically extending reinforcing liner 16 is arranged so that the entire region of the recess 1e is lined by the liner 16. Since the length of the reinforcing ferric metal liner 16 is made to be longer than the circumferential length of the recess 1e, the opposite ends of the liner 16 are respectively pressed against and rigidly held by the shoulders 1f of the housing unit 1d. The reinforcing ferric metal liner 16 may be adhesively attached to the bottom of the circumferentially extending recess 1e of the housing unit 1 as required.

The description of the function of the reinforcing ferric metal liner 16 is provided hereinbelow.

When the movable spiral member 9b of the movable scroll unit 9 moves along the predetermined orbiting path in response to the rotation of the drive shaft 4, there may occur such an undesirable condition that the movable spiral member 9b orbiting while maintaining mechanical engagement with the stationary spiral member 1b of the stationary scroll unit 1 seizes due to, for example, friction generated heat in the engaging portion of the two members 1b and 9b to thereby cause breakage of the stationary and movable spiral members 1b and 9b. Thus, foreign materials consisting of a broken piece or pieces of the two members 1b and 9b enter between the outer circumference of the movable spiral member 9b of the movable scroll unit 9 and the inner face of the wall portion of the housing unit 1d, and accordingly, jamming of the movable spiral member 9b of the movable scroll unit 9 may occur. At this stage, the reinforcing ferric metal liner 16 lining the cylindrical inner face of the housing unit 1 prevents the housing unit 1 made of aluminum or aluminum alloy from being damaged. Namely, only the movable spiral member 9b in the form of a thin blade-like member is initially damaged and broken. Accordingly, the housing unit 1d of the stationary scroll unit 1 can be protected from being cracked. Consequently, the refrigerant gas in the compressor does not leak toward the exterior of the compressor.

As described before, since the length of the reinforcing ferric metal liner 16 is longer than that of the recess 1e of the housing unit 1, it is ensured that when the aluminum or aluminum alloy housing unit 1 is thermally extended so as to circumferentially extend the length of the recess 1e, the reinforcing ferric metal liner 16 of which the thermal extension is less than that of the aluminum housing unit 1 can compensate for the extension of the recess 1e. Namely, the reinforcing liner 16 can be constantly and tightly attached to the inner face of the housing unit 1, and no separation of the liner 16 from the inner face of the housing unit 1 occurs even if the former is not bonded to the latter by adhesive.

The arrangement of the reinforcing ferric metal liner 16 may be changed from that of the embodiment of FIG. 2.

Figure 3:
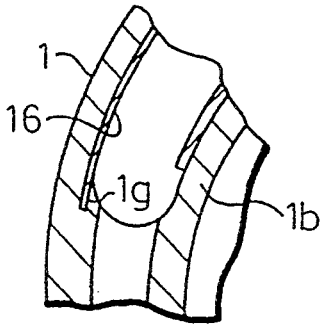
FIG. 3 is a partial cross-sectional view of a modification of the embodiment of FIG. 1, illustrating a part corresponding to the portion "A" of the scroll type refrigerant compressor shown in FIG. 1.
Figure 4:
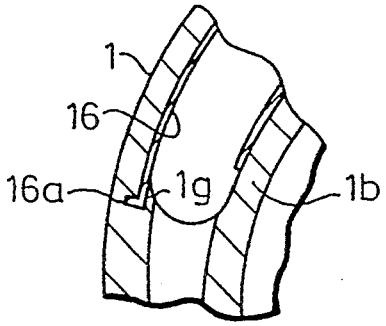
FIG. 4 is a partial cross-sectional view of a further modification of the embodiment of FIG. 1, illustrating a part corresponding to the portion "A" of the scroll type refrigerant compressor shown in FIG. 1; and, FIG. 5 is a cross-sectional view similar to FIG. 2, illustrating a still further embodiment of the present invention.

For example, as shown in FIG. 3, the opposite ends of the liner 16 may be inserted into pockets 1g formed at the ends of the recess 1e of the housing unit 1. Further, as shown in FIG. 4, the reinforcing ferric metal liner 16 may be provided with rectangularly curved lips 16a at the opposite ends thereof so that the lips 16a are inserted and fitted in pockets 1g formed at the ends of the recess 1e of the housing unit 1.

Figure 5:
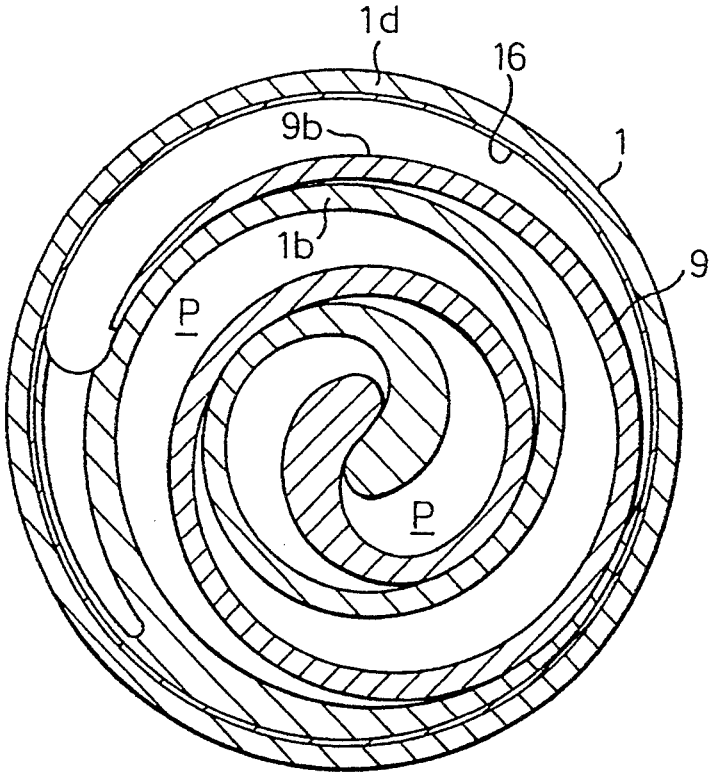

FIG. 5 illustrates a different embodiment of the arrangement of the reinforcing ferric metal liner 16. In the embodiment of FIG. 5, the reinforcing liner 16 is formed as a complete cylindrical hollow element, and the cylindrical element, i.e., the reinforcing liner 16 is embedded in the inner face of the housing unit 1 when the aluminum or aluminum alloy stationary scroll unit 1 is produced by a known casting method.

It should be appreciated that further modification and alternations of the present invention will occur to persons skilled in the art without departing from the scope of the present invention. For example, the reinforcing ferric metal liner according to the present invention may be applied to a housing unit of a scroll type refrigerant compressor in which the housing unit is formed separately from the stationary spiral member of the stationary scroll unit.

From the foregoing description of the invention, it will be understood that the reinforcing ferric metal liner in the form of a cylindrical member mechanically stronger than the aluminum or aluminum alloy housing unit of a scroll type refrigerant compressor can enhance the mechanical strength and durability of the housing unit against an accident such as jamming of the movable scroll unit occuring due to intrusion of various foreign materials into a small space between the outer face of the movable spiral member of the movable scroll unit and the inner face of the cylindrical wall portion of the housing unit of the compressor. Thus, a long operation life of the scroll type refrigerant compressor can be ensured.

Further, according to the present invention, the housing unit of the scroll type refrigerant compressor can be mechanically reinforced without increasing the thickness thereof, and accordingly the entire size of the compressor can be made rather small.

We claim:

1. A scroll type refrigerant compressor comprising:

a housing means made of light material such as aluminum or aluminum alloy, and having a substantially cylindrical wall defining an encasing space therein;

a stationary scroll means including a stationary spiral member attached to a first end plate and fixedly encased in said encasing space of said housing means;

a movable scroll means movably encased in said encasing space of said housing means and cooperating with said stationary scroll means, said movable scroll means including a movable spiral member arranged so as to be angularly shifted with respect to said stationary spiral member and attached to a second end plate disposed at a position axially spaced apart and opposed to said first end plate of said stationary scroll means, said movable spiral member of said movable scroll means being arranged so as to be non-rotatable about a center thereof and moved along a predetermined orbiting path with respect to said stationary scroll means under such a condition that, during said orbiting movement of said movable spiral member, partial engagement thereof with said stationary spiral member is constantly maintained so as to define a closed compressing chamber therebetween gradually reducing a volume thereof by shifting from an outer region toward a central region of said stationary and movable scroll means, and reinforcing metallic plate means for lining an inner cylindrical face of said cylindrical wall of said housing means made of said aluminum or aluminum alloy, said reinforcing metallic plate means having sufficient mechanical strength for preventing said inner cylindrical face of said cylindrical wall of said housing means from being mechanically damaged by said movable spiral member of said movable scroll means.

2. A scroll type refrigerant compressor according to claim 1, wherein said reinforcing metallic plate means comprises a piece of ferric metal liner received in a cylindrically extending recess formed in said inner cylindrical face of said cylindrical wall of said housing means, said reinforcing ferric metal liner having opposite ends pressed against shoulders formed at ends of said cylindrical recess.

3. A scroll type refrigerant compressor according to claim 2, wherein said reinforcing ferric metal liner is adhesively attached to said cylindrical recess of said cylindrical wall of said housing unit.

4. A scroll type refrigerant compressor according to claim 2, wherein said opposite ends of said reinforcing ferric metal liner are fitted in pockets formed at ends of said cylindrical recess of said cylindrical wall of said housing means.

5. A scroll type refrigerant compressor according to claim 2, wherein said opposite ends of said reinforcing ferric metal liner are provided with curved lips fitted in pockets formed at ends of said cylindrical recess of said cylindrical wall of said housing means.

6. A scroll type refrigerant compressor according to claim 1, wherein said reinforcing metallic plate means comprises a cylindrical ferric metal liner embedded in said inner cylindrical face of said cylindrical wall of said housing means by casting.

7. A scroll type refrigerant compressor of claim 1 wherein the reinforcing metallic plate has a thickness of 1 mm.

8. A scroll type refrigerant compressor of claim 2 wherein the ferric metal liner has a thickness of 1 mm.

9. A scroll type refrigerant compressor of claim 3 wherein the enforcing ferric metal liner has a thickness of 1 mm.

10. A scroll type refrigerant compressor of claim 4 wherein said reinforcing ferric metal liner has a thickness of 1 mm.

11. A scroll type refrigerant compressor of claim 5 wherein said reinforcing ferric metal liner has a thickness of 1 mm.

12. A scroll type refrigerant compressor of claim 6 wherein said cylindrical ferric metal liner has a thickness of 1 mm.

* * * * *